US005617596A

United States Patent [19]

Boyd

[11] Patent Number: 5,617,596

[45] Date of Patent: Apr. 8, 1997

[54] TUBE FOR A WATERBED

[76] Inventor: Dennis Boyd, 14457 Rouge River, Chesterfield, Mo. 63017

[21] Appl. No.: 641,578

[22] Filed: May 1, 1996

[51] Int. Cl.[6] ..... A47C 27/08

[52] U.S. Cl. ..... 5/683; 5/685

[58] Field of Search ..... 5/682, 683, 685, 5/919, 920, 711, 712

[56] References Cited

U.S. PATENT DOCUMENTS

| | | | |
|---|---|---|---|
| 4,221,013 | 9/1980 | Echevarria . | |
| 4,241,465 | 12/1980 | Yarimie | 5/682 |
| 4,912,789 | 4/1990 | Maxwell | 5/685 |
| 5,031,260 | 7/1991 | LeBianco | 5/682 |
| 5,077,848 | 1/1992 | McDaniel | 5/685 |

*Primary Examiner*—Flemming Saether
*Attorney, Agent, or Firm*—Polster, Lieder, Woodruff & Lucchesi

[57] ABSTRACT

A tube for a waterbed includes a generally cylindrical tube body having a top, a bottom, and a pair of side walls extending from the top to the bottom. The tube body defines a longitudinal axis of the tube. First and second tube ends in combination with the tube body form a watertight enclosure. A fill valve is provided through which the watertight enclosure may be at least partially filled with water. Metering walls are disposed in the watertight enclosure generally transverse to the longitudinal axis of the tube, each pair of metering walls defining a tube section therebetween. The metering walls extend across the tube body from one side to the other and are sealed to each side wall. The metering walls have a top portion that is spaced from the top of the tube body to permit the metered flow of water from one tube section to another. They may also have a bottom portion that is spaced from the bottom of the tube body. The ends of the metering walls are connected to the side walls of the tube body with soft seals, so that if the soft seals break water is not released from the watertight enclosure. The metering walls flex in the vicinity of their top openings to relieve pressure and stress on the components of the tube.

16 Claims, 1 Drawing Sheet

TUBE FOR A WATERBED

BACKGROUND OF THE INVENTION

This invention relates to waterbeds, and more particularly to tubes for waterbeds.

The advantages and benefits of waterbeds over conventional beds are well-known. There have, however, heretofore been some perceived disadvantages of waterbeds which have slowed their acceptance. One of these perceived disadvantages has been the presence of a hard wooden frame around the outside of the waterbed mattress(es) to hold the mattress(es) in place.

This particular perceived disadvantage has been overcome in part recently by the introduction of softside waterbeds. These waterbeds use a layer of foam which extends as a collar around the periphery of the waterbed to hold the waterbed mattress in place. In soft-side waterbeds, the mattress is often composed of a plurality of parallel water-containing tubes, which extend from head to foot of the mattress. When disposed in this manner, waterbed tubes substantially prevent side to side wave motion in the waterbed.

However, waterbed tubes could be improved. When a user lies on his side on a waterbed tube mattress, his shoulder may rapidly displace the water under the shoulder and force it to rush to the foot of the bed. The user's feet are then elevated in an exaggerated manner. As the water rebounds from the end of the tube, it shoots back toward the head of the bed, creating a "teeter-totter" effect.

Various systems, such as the foam or fiber-filled tubes disclosed in U.S. Pat. No. 4,221,013, address this problem, but they could be improved. For example, a foam-filled tube reduces the rapid water movement but does not eliminate the rapid displacement effect or the "teeter-totter" effect. Moreover, in foam-filled tubes the foam can bunch together in the filling, draining, moving or burping process, which significantly reduces the anti-wave properties. Foam is also a natural harbor for bacteria and air cells. The bacteria deteriorate the quality of the vinyl of which the tubes are made and diminish the life of the tube. Air trapped in the foam is released from the open cells and can cause annoying noises unless burped.

Upon draining a foam-filled tube, a substantial amount of water remains in the foam, creating an unnecessarily heavy tube which can be difficult to transport and which is also subject to bacterial, fungal and/or algae growth. Moreover, a foam-filled waterbed tube has a higher cubic volume than a non-foam filled tube, with the result that shipping costs are increased. This is particularly a problem in export containers.

Various foam-filled waterbed tubes have been devised to hold the foam or fiber in place in the tube. Unfortunately, these usually involve additional seals to the vinyl of the waterbed tube which can be uncomfortable to the user, and can, if they fail, result in a leak from the tube.

SUMMARY OF THE INVENTION

Among the various objects and features of the present invention may be noted the provision of an improved waterbed tube which substantially eliminates rapid water movement within the tube.

Another object is the provision of such an improved waterbed tube which eliminates the "teeter-totter" effect.

A third object is the provision of such an improved waterbed tube which solves the problem of bunching of foam or fiber, which otherwise naturally occurs in such tubes.

A fourth object is the provision of such an improved waterbed tube which is significantly less subject to bacterial attack.

A fifth object is the provision of such an improved waterbed tube which is substantially lighter in weight when drained.

A sixth object is the provision of such an improved waterbed tube which has a reduced volume for shipping.

A seventh object is the provision of such an improved waterbed tube which is more comfortable and less prone to leakage.

An eighth object is the provision of such an improved waterbed tube which is relatively easy to burp, so as to substantially remove all the air from inside the tube.

Other objects and features will be in part apparent and in pan pointed out hereinafter.

Briefly, a waterbed tube of the present invention includes a generally cylindrical tube body having a top, a bottom, and a pair of side walls extending from the top to the bottom, the tube body defining a longitudinal axis of the tube. First and second tube ends are provided that in combination with the tube body form a watertight enclosure. A fill valve through which the watertight enclosure may be at least partially filled with water is disposed in one surface of the tube body. Metering walls are disposed in the watertight enclosure generally transverse to the longitudinal axis of the tube, each pair of metering walls defining a tube section therebetween. The metering walls extend across the tube body from one side to the other and are sealed to each side wall. The metering walls have a top portion which is spaced from the top of the tube body to permit the metered flow of water from one tube section to another.

BRIEF DESCRIPTION OF THE DRAWINGS

Similar reference characters indicate similar parts throughout the several views of the drawings.

DESCRIPTION OF THE PREFERRED EMBODIMENT

Figure 1:
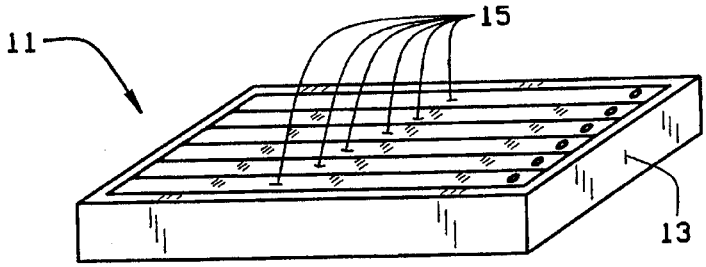
FIG. 1 is a perspective view of a waterbed using the tubes of the present invention.

Turning now to the drawings, a waterbed 11 is shown having a conventional softside mattress frame 13 holding a plurality of waterbed tubes 15 extending from head to foot of the waterbed. Each tube 15 has a fill valve 17 disposed either in the top of the tube as shown or in one end of the tube.

Figure 2:
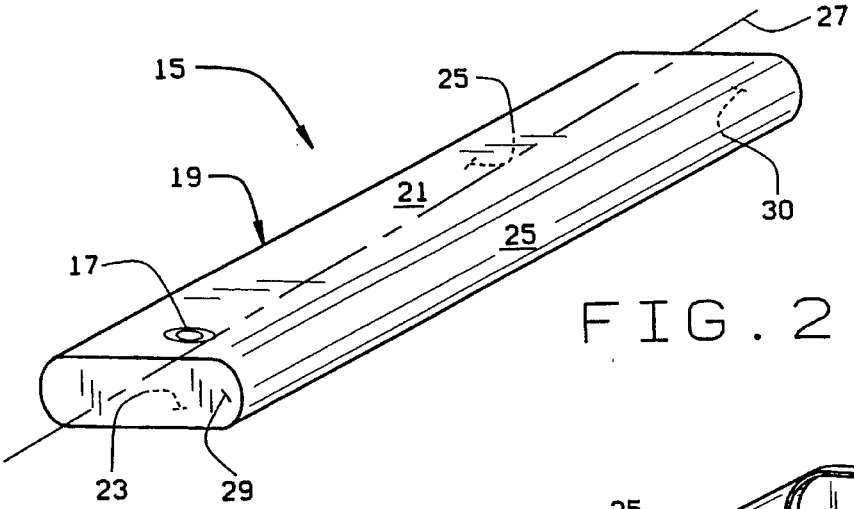
FIG. 2 is a perspective view, on an enlarged scale, of the exterior of one of the tubes of the present invention.
Figure 3:
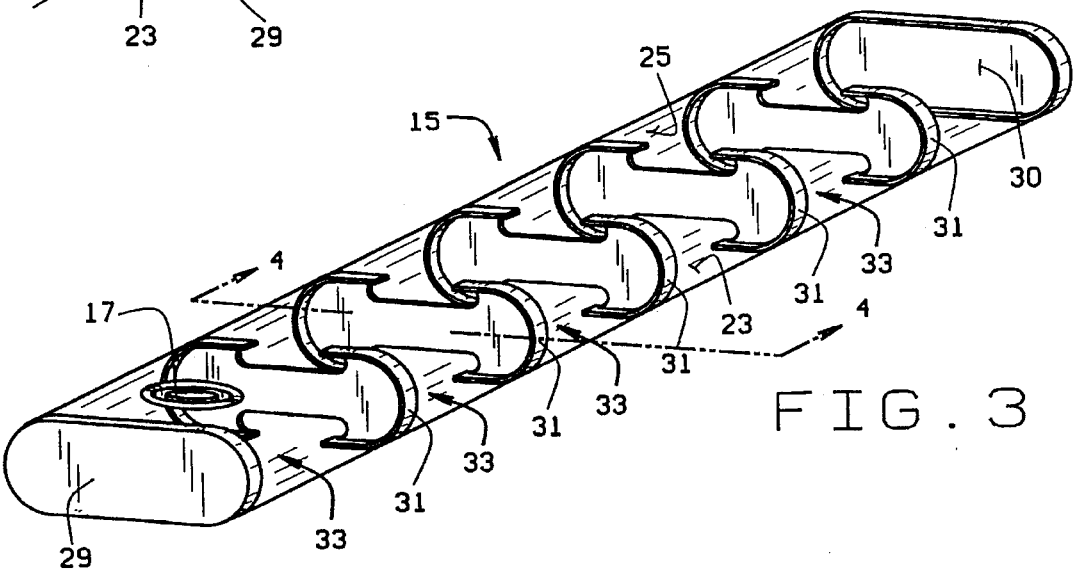
FIG. 3 is a perspective view, on an even greater scale, illustrating the interior of one of the tubes of the present invention.

As shown in FIGS. 2 and 3, each tube 17 includes a generally cylindrical tube body 19 having a top 21, a bottom 23, and a pair of side walls 25 extending from top 21 to bottom 23. Tube body 19 defines a longitudinal axis 27 of tube 17. The tube also includes first and second tube ends 29, 30 that, in combination with tube body 19 forms a watertight enclosure. As is known, waterbed tubes are conventionally made of vinyl with the necessary seams either lap seamed or butt seamed. It is preferred that the watertight enclosure be made using lap seams.

Waterbed tubes 17 differ significantly from conventional waterbed tubes in having metering walls 31 (see FIGS. 3–5) disposed in the watertight enclosure generally transverse to the longitudinal axis of each tube. For clarity only five such metering walls 31 are shown. However, it is preferred that a larger number, such as seven, be used. For example, with seven metering walls, the first and last metering walls are preferably disposed approximately 12-⅞" from their respective ends of their tube, with the remaining five metering walls being disposed at 7-⅞" intervals therebetween. More metering walls can be added for a greater hydraulic affect (less movement). Or fewer walls can be used for a reduced affect (more movement).

Each pair of metering walls 31 defines a tube section 33 therebetween, and the first and last metering walls define tube sections with their respective tube ends 29 and 30. Each metering wall extends transversely across the tube body from one side 25 to the other and is sealed to each side wall with a soft seal. A soft seal is used so that if the metering wall 31 separates from side wall 25 it does not tear the side wall, and no leak results. It should be noted that each metering wall 31 has a top portion (see FIG. 4) which is spaced from the top 21 of the tube body to permit the metered flow of water from one tube section to another. Preferably, it also includes a bottom portion which is spaced from the bottom 23 of the tube body. Each metering wall has a central wall portion 45 which terminate in first and second flanges 47, 49. The central wall portion 45 and flanges 47, 49 are preferably made of a conventional waterbed material such as vinyl. The flanges are suitably secured to the tube body by the soft seals as described above.

Figure 4:
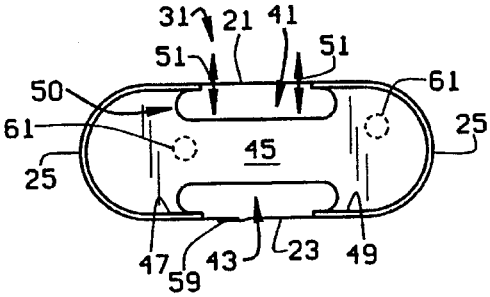
FIG. 4 is a cross-sectional view of the tube of FIG. 3.

It is preferred that, as shown in FIG. 4, flanges 47, 49 overhang openings 41 and 43 as indicated at 50. The flanges are resilient so that the portion of the flanges overhanging the openings move vertically (as indicated by arrows 51 ) when pressure is applied to the tube body to relieve stress on the seals when pressure is applied to the tube body. Similarly, the central wall portion is also resilient so that the crescent-shaped portion of the central wall may also flex up and down when pressure is applied. This reduces tension on the seams and extends the effective life of the tube.

Figure 5:
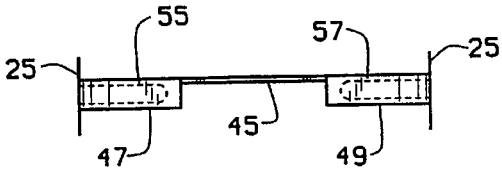
FIG. 5 is a top plan of the tube of FIG. 3, with pans broken away for clarity.

As is shown in FIG. 5 by a pair of seals 55, 57, each flange is secured to its respective side wall 25 by a suitable soft rf ( radio frequency) seal. Alternatively, the flanges can each be sealed to the tube body by a pair of seals to create a double wall effect. In any event, it is preferred that the seals connecting the flanges to the side walls be spaced from any seals of the tube body itself. For example, to make the tube body, it is conventional to have a lap seam 59 which runs longitudinally along the bottom of the tube. The flange seals all terminate short of all such seals. Double-sealing, which the present construction avoids, would undesirably weaken the structural tube seals.

Although central wall 45 is shown as solid in FIG. 4, it may also (as indicated in phantom at 61) have internal venting holes for allowing water to pass from one tube section to the next through the venting holes.

It is preferred that the top two inches of each tube be left unseamed to allow for ease of burping the tubes. Air rises to the top of the tube and can be easily extracted by applying slight hand pressure at the end of the tube steadily to force the air to the fill valve.

Tube 15 made in accordance with the present construction slowly meters the flow of water from one compartment 33 of the tube to the next. A user is unaware of the gradual displacement. There is no "rebound," so the teeter-totter effect is eliminated. Since there is no foam anti-wave material, all the negative aspects of foam-filled tubes are eliminated.

In view of the above, it will be seen that all the objects and features of the present invention are achieved, and other advantageous results obtained. The description of the invention contained herein is illustrative only, and is not intended in a limiting sense.

What is claimed is:

1. A tube for a waterbed, comprising:

a generally cylindrical tube body having a top, a bottom, and a pair of side walls extending from said top to said bottom, said tube body defining a longitudinal axis of said tube for a waterbed;

first and second tube ends, said tube ends in combination with said tube body forming a watertight enclosure;

a fill valve through which the watertight enclosure may be at least partially filled with water;

a plurality of metering walls disposed in the watertight enclosure generally transverse to the longitudinal axis of the tube, each pair of metering walls defining a tube section therebetween, said metering walls extending across the tube body from one side to the other and being sealed to each side wall;

said metering walls having a top portion which is spaced from the top of said tube body to permit the metered flow of water from one tube section to another.

2. The tube for a waterbed as set forth in claim 1 wherein said metering walls have a bottom portion which is spaced from the bottom of said tube body.

3. The tube for a waterbed as set forth in claim 1 wherein said metering walls have a central wall portion which terminates in first and second flanges, said flanges being suitably secured to said tube body.

4. The tube for a waterbed as set forth in claim 3 wherein said central wall portion of each metering wall has a opening at the top thereof, said first and second flanges overhanging said opening.

5. The tube for a waterbed as set forth in claim 4 wherein said first and second flanges are resilient so as to allow the portion of said flanges overhanging said opening to move vertically when pressure is applied to the tube body.

6. The tube for a waterbed as set forth in claim 3 wherein said central wall portion of each metering wall has a opening at the bottom thereof, said first and second flanges extending under a portion of said opening.

7. The tube for a waterbed as set forth in claim 6 wherein said first and second flanges are resilient so as to allow stress relieving motion of the flanges when pressure is applied to the tube body.

8. The tube for a waterbed as set forth in claim 3 wherein said first and second flanges are sealed to the tube body by soft seals.

9. The tube for a waterbed as set forth in claim 3 wherein said first and second flanges are each sealed to the tube body by a pair of seals.

10. The tube for a waterbed as set forth in claim 3 wherein the central wall portion is substantially planar and the first and second flanges extend from said central wall portion in the same direction.

11. The tube for a waterbed as set forth in claim 1 wherein said tube body is made watertight by a plurality of tube body seals, the metering walls being sealed to the tube walls by seals which are spaced from said tube body seals.

12. The tube for a waterbed as set forth in claim 11 wherein the tube body seals are lap seams.

13. The tube for a waterbed as set forth in claim 1 wherein said metering walls further define internal venting holes for allowing water to pass from one tube section to the next through said venting holes.

14. The tube for a waterbed as set forth in claim 1 wherein the fill valve is disposed in the top of the tube body.

15. The tube for a waterbed as set forth in claim 1 wherein there are at least five metering walls longitudinally disposed in the tube body.

16. The tube for a waterbed as set forth in claim 1 wherein each metering wall includes a pair of crescent-shaped sections defining ends of said top portion, said crescent-shaped sections being resilient so as to allow the wall to simultaneously and bidirectionally expand up and down as water is forced through the space between the tube body and the top portion of the metering,wall.

* * * * *